US008904821B1

(12) United States Patent
DiPietro

(10) Patent No.: US 8,904,821 B1
(45) Date of Patent: Dec. 9, 2014

(54) JEWELRY CLASP

(71) Applicant: Jason DiPietro, East Providence, RI (US)

(72) Inventor: Jason DiPietro, East Providence, RI (US)

( * ) Notice: Subject to any disclaimer, the term of this patent is extended or adjusted under 35 U.S.C. 154(b) by 0 days.

(21) Appl. No.: 14/271,583

(22) Filed: May 7, 2014

(51) Int. Cl.
*A44C 5/00* (2006.01)
*A44B 99/00* (2010.01)
*A44C 11/00* (2006.01)

(52) U.S. Cl.
CPC . *A44B 99/00* (2013.01); *Y10S 63/90* (2013.01)
USPC ..... 63/3.1; 63/40; 63/900; 63/21; 63/23; 24/303

(58) Field of Classification Search
USPC ..... 63/3.1, 900, 21, 23, 40; 24/303
See application file for complete search history.

(56) References Cited

U.S. PATENT DOCUMENTS

| | | | | |
|---|---|---|---|---|
| 5,669,242 | A * | 9/1997 | Cayton | 63/21 |
| D487,709 | S | 3/2004 | Ferlise | |
| D498,167 | S | 11/2004 | Ferlise | |
| 6,981,391 | B2 * | 1/2006 | Suzuki | 63/3.1 |
| D602,799 | S | 10/2009 | Colombani | |
| D619,026 | S | 7/2010 | Papadimitriou | |
| D639,198 | S | 6/2011 | Nigro | |
| D658,085 | S | 4/2012 | Rafaelian | |
| 8,701,438 | B1 * | 4/2014 | Kovel | 63/3.1 |
| 2008/0127677 | A1 * | 6/2008 | Williams | 63/3.1 |

* cited by examiner

*Primary Examiner* — Jack W Lavinder
(74) *Attorney, Agent, or Firm* — Salter & Michaelson

(57) ABSTRACT

A jewelry clasp for use with a jewelry band including a base piece having an open passage at one side thereof; an insert piece having an attachment end and an insert end; a first magnetic member disposed at a bottom of the open passage; and a second magnetic member disposed at a free end of the insert end of the insert piece. The insert piece has an insert position in which the insert end is free to extend into and out of the open passage, and a locked position in which the insert piece is secured with the base piece by relative rotation.

7 Claims, 7 Drawing Sheets

JEWELRY CLASP

FIELD OF THE INVENTION

The present invention relates in general to a jewelry clasp and pertains, more particular to an improved clasp that can be used with a bracelet or bangle and that provides for a ready engagement.

BACKGROUND OF THE INVENTION

There are a variety of different jewelry clasps that are known. However, for many of these jewelry clasp designs there is a difficulty in providing a quick and effective engagement of the clasp.

Accordingly, it is an object of the present invention to provide an improved jewelry clasp that provides an effective engagement. Another object of the present invention is to provide a jewelry clasp that is particularly adapted for use with a bracelet, bangle or necklace structure.

SUMMARY OF THE INVENTION

To accomplish the foregoing and other objects, features and advantages of the present invention there is provided a jewelry clasp for use with a jewelry band and comprising:

a base piece having an open passage at one side thereof; an insert piece having an attachment end and an insert end;

said insert piece having an insert position in which the insert end is free to extend into and out of the open passage, and a locked position in which the insert piece is secured with the base piece;

a first magnetic member disposed at a bottom of the open passage; and a second magnetic member disposed at a free end of the insert end of the insert piece.

In accordance with other aspects of the present invention said base piece has an entry slot having a width that is greater than a length thereof; said base piece includes an annular slot disposed inward of said entry slot; said base piece includes a free end stub that supports the first magnetic member; said insert piece includes a head and at least one projection disposed inward of the head and for insertion through the entry slot and for engagement with the annular slot; the projection passes through the entry slot when in the insert position and the insert piece is rotated in the annular slot in the locked position in order to secure the insert piece with the base piece; the projection is comprised of a pair or posts that extend from opposed sides of the insert piece; said insert piece includes a head and at least one projection disposed inward of the head and for insertion into the open passage of the base piece; including a retaining loop supported at the head of the insert piece for attachment with a charm or the like; said first magnetic member comprises a magnet; said second magnetic member comprises a magnet; said base piece has an entry slot that accepts the insert piece in substantially only one position, and an annular slot disposed inward of said entry slot, said base piece having a cylindrical body and said insert piece also being cylindrical and including a head and a stem extending from the head, a securing loop supported at the head and a pair of posts extending from opposed sides of the stem and for engagement with the annular slot, said insert piece being rotatable in said annular slot in order to lock the insert piece relative to the base piece; the first magnetic member is disposed in the cylindrical body of the base piece at the bottom of the open passage, said second magnetic member being disposed at a free end of the stem opposite to the head of the insert piece.

In accordance with another version of the present invention there is provided a combination jewelry band, pair of clasps, and a charm adapted to be supported between the respective clasps, said combination comprising: a first clasp and a second clasp, each clasp including a base piece having an open passage at one side thereof; and an insert piece having an attachment end and an insert end; a first magnetic member disposed at a bottom of the open passage; and a second magnetic member disposed at a free end of the insert end of the insert piece; each clasp secured at opposed ends of the jewelry band; each said clasp including a securing loop for attachment with a charm.

In accordance with still other aspects of the present invention said base piece has an entry slot and an annular slot disposed inward of said entry slot; each said base piece includes a free end stub that supports the first magnetic member, and said insert piece includes a head and at least one projection disposed inward of the head and for insertion through the entry slot and for engagement with the annular slot; the projection passes through the entry slot when in the insert position and the insert piece is rotated in the annular slot in the locked position in order to secure the insert piece with the base piece; the projection is comprised of a pair or posts that extend from opposed sides of the insert piece; each said insert piece includes a head and at least one projection disposed inward of the head and for insertion into the open passage of the base piece; said first magnetic member comprises a magnet, and said second magnetic member comprises a magnet.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 10:
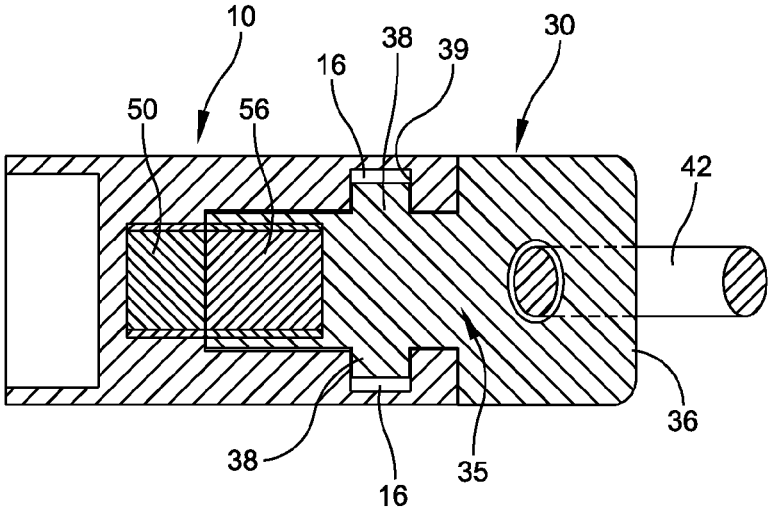
FIG. 10 is a cross-sectional view taken along line 10-10 of FIG. 9.
Figure 11:
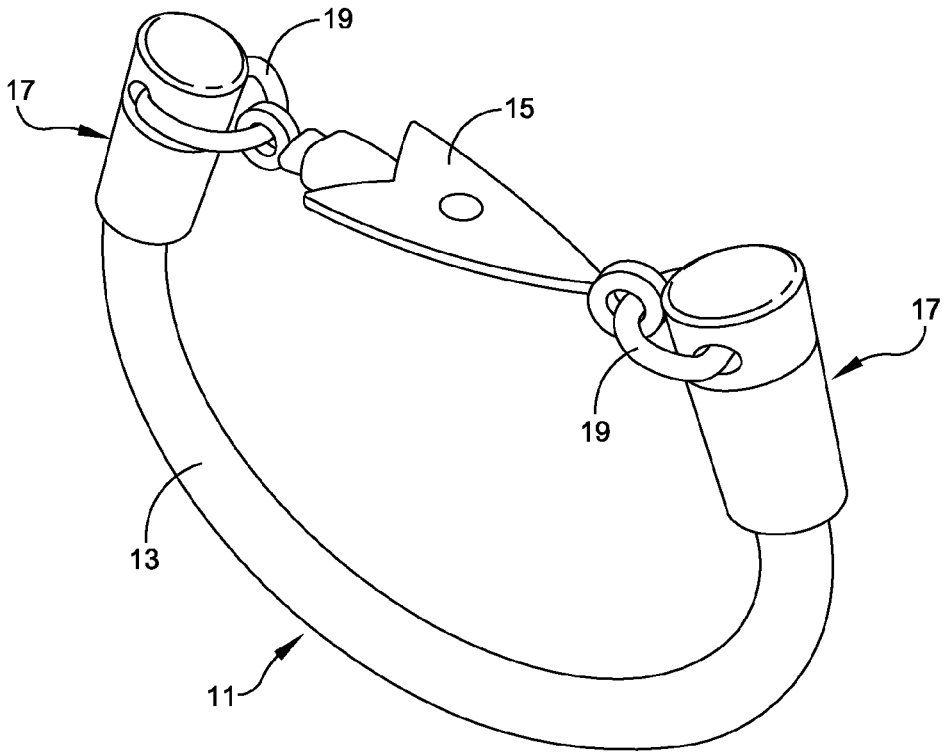
FIG. 11 illustrates a complete piece of jewelry such as a bracelet or band embodying one or more of the clasps of the present invention.

Reference is now made to the drawings for an illustration of the jewelry clasp of the present invention. FIGS. 1-10 illustrate certain positions of the components of the clasp along with cross-sectional views. FIG. 11 illustrates a jewelry piece 11 that is comprised of an elongated band 13 and end claps 17. The band 13 may take on many different forms including a chain. FIG. 11 also illustrates a charm 15 supported between loops 19 of the jewelry clasp 17. Further details of the jewelry clasp 17 are found in FIGS. 1-10.

The jewelry clasp is comprised of a base piece 10 that is basically of cylindrical construction, although, it may be of other shapes such as oval, square or rectangular. The base piece 10 is provided with an open passage 12 at one side thereof and is considered as having a bridging stub 18 that defines a blind end of the passage 12. The jewelry clasp of the present invention is also comprised of an insert piece 30 having an attachment end 32 and an insert end 34. The insert piece is considered as having an insert position in which the insert end is free to extend into and out of the open passage 12, and a locked position in which the insert piece is secured with the base piece. As illustrated in, for example, FIGS. 2 and 3, there is also provided a first magnetic member 50 disposed at the bottom blind end of the passage 12 and a second magnetic member 56 disposed at a free end 57 of the insert end 34.

Figure 1:
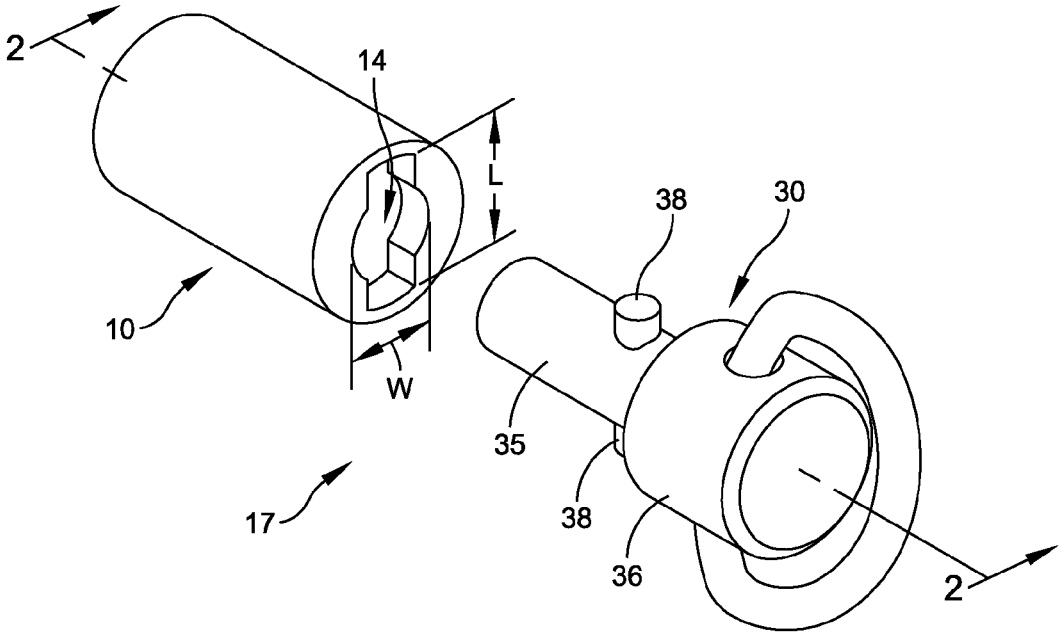
FIG. 1 is a perspective view of the jewelry clasp of the present invention.

As illustrated in FIG. 1, the base piece has an entry slot 14 that has a width W that is greater than its length L. As also illustrated in, for example, FIGS. 2 and 3, the base piece includes, in addition to the entry slot 14, which is keyhole shaped, an annular slot 16. The annular slot 16 is disposed inward of the entry slot 14. As previously mentioned, the magnetic member 50 is supported within a bridging stub 18 at the very end of the passage 12.

The insert piece 30, as previously mentioned, has an insert end 34 and an attachment end 32. The attachment end 32 is basically comprised of an enlarged head 36. The insert end 34 is basically comprised of a somewhat elongated stem 35 having a free end 57. It is the magnetic member 56 that is disposed at this free end having an exposed magnetic surface 59 that is flush with the free end 57.

Figure 2:
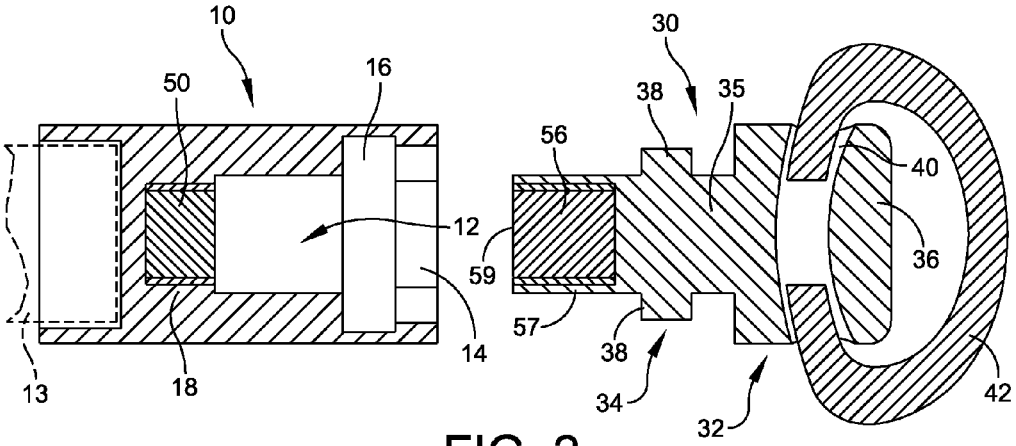
FIG. 2 is a cross-sectional view of the jewelry clasp taken along line 2-2 of FIG. 1.
Figure 3:
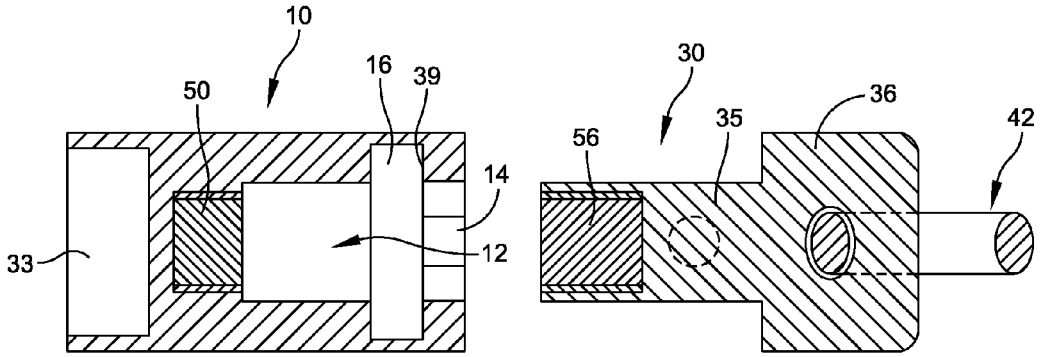
FIG. 3 is a cross-sectional view similar to that shown in FIG. 2 but taken at a 90 degree angle.
Figure 4:
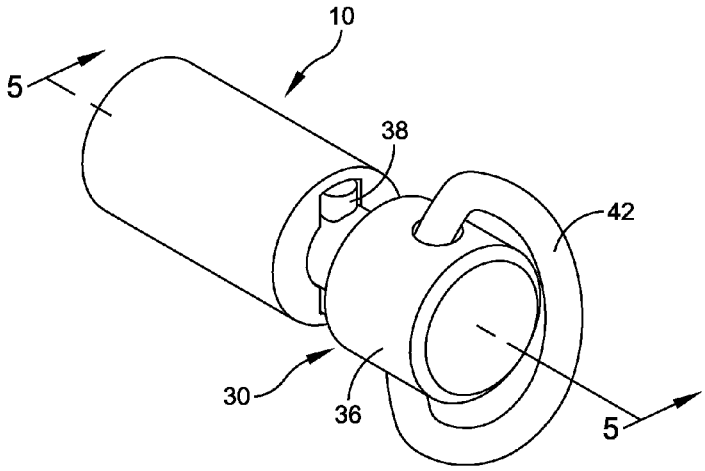
FIG. 4 is a perspective view of the same clasp with the insert piece engaged with the base piece.

The stem 35 also includes at least one projection that is spaced inward from the head 36. This trajection extends through the entry slot and is for engagement with the annular slot 16. When the projection passes through the entry slot, once the insert piece is rotated into the annular slot, this locks the insert piece with the base piece. In the illustrated embodiment, the locking projection is in the form of a pair of opposed position posts 38. These posts are illustrated in FIGS. 1 and 2, as well as in other cross-sectional views.

Figure 5:
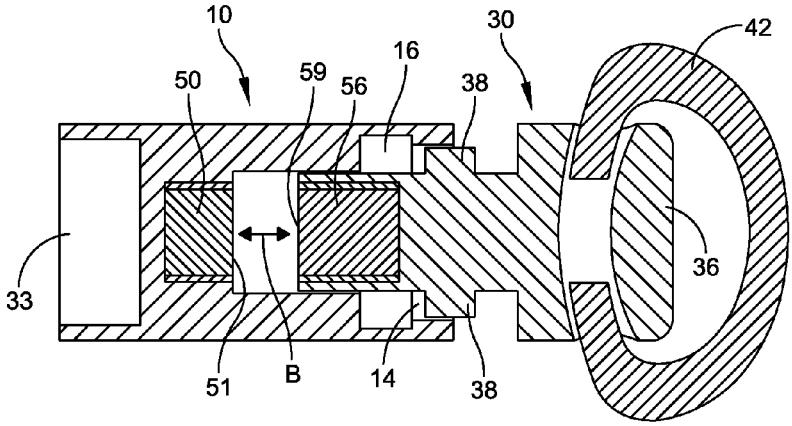
FIG. 5 is a cross-sectional view taken along line 5-5 of FIG. 4.
Figure 6:
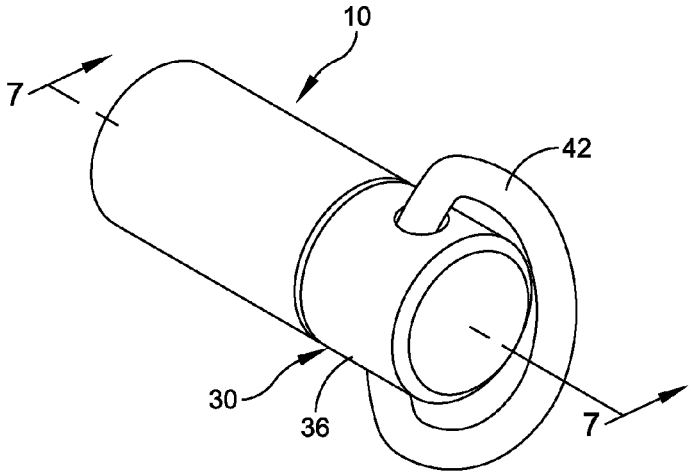
FIG. 6 is a perspective view of the jewelry clasp of the present invention with the insert piece fully engaged with the base piece but without the insert piece yet locked in position.

Regarding the magnetic members 50 and 56, these can be opposed polarity magnets or one of them can be constructed of a magnetic material. In either case, these provide an attraction force therebetween. In this regard, in the cross-sectional views of FIGS. 2 and 3, the insert piece 30 is positioned away from the base piece 10. In the cross-sectional view of FIG. 5, the insert piece 30 is partially engaged with the base piece 10. FIG. 5 illustrates the projecting posts 38 passing through the entry slot 14 but not yet disposed within the annular slot 16. In FIG. 5 it is noted that the magnets 50 and 56 are still spaced apart but would be providing some attraction force between magnet surface 59 and magnet surface 51. In the cross-sectional view of FIG. 7 the insert piece 30 is fully engaged within the open passage 12 of the base piece 10 but the insert piece has not yet been rotated into a locked position. However, in FIG. 7 there is a relatively strong attraction force between the magnets 50 and 56 holding the insert piece 30 in place within the base piece 10. The cross-sectional view of FIG. 10 illustrates the insert piece 30 having been rotated 90 degrees (see also the rotational arrows A in FIG. 8). It is noted in the position of FIG. 10 that each of the posts 38 is engaged within the annular slot 16 and is locked in position by virtue of each of the posts 38 engaging a wall surface 39 defining the annular slot 16. Also, not illustrated herein, there may be provided detents that limit the position of rotation of the insert piece 30.

Figure 8:
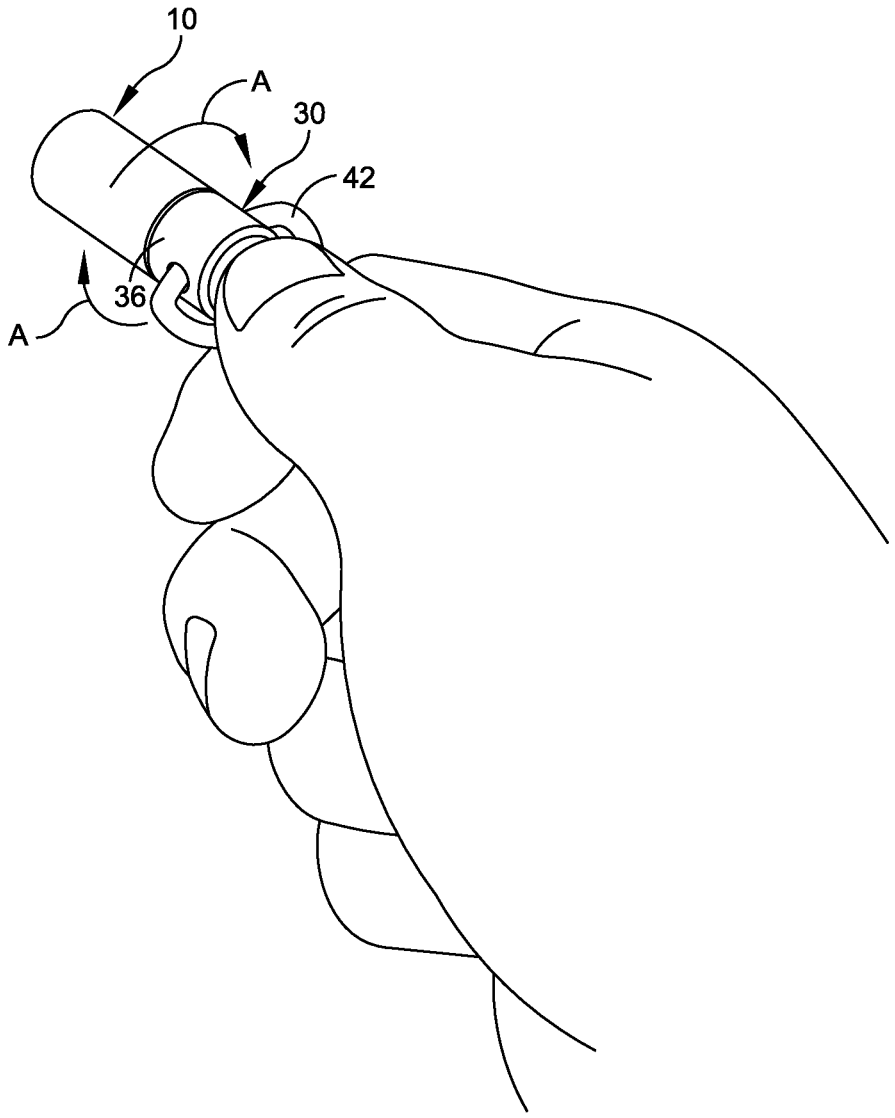
FIG. 8 is an illustrative view showing the insert piece being rotated for locking the clasp.
Figure 9:
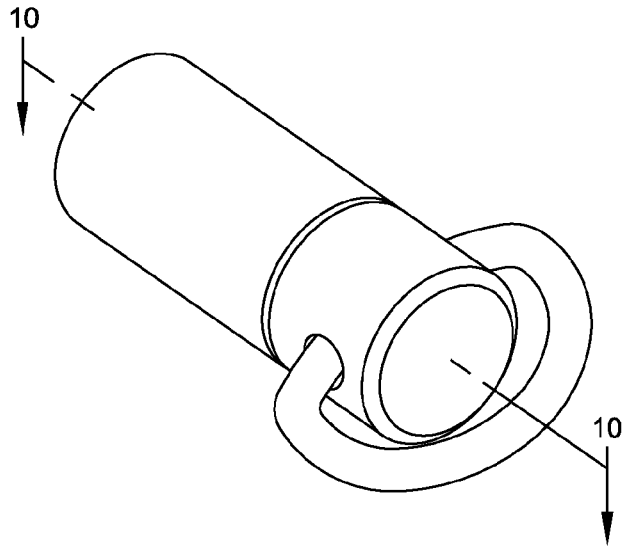
FIG. 9 is a further perspective view of the clasp of the present invention in its locked position.

For the purpose of rotating the insert piece, there is provided a channel 40 in the head 36. The securing loop 42 has ends that engage within the channel 40. FIG. 8 illustrates the user grasping the loop 42 for turning the insert piece in the direction of arrow A from an entry position to a locked position.

Figure 7:
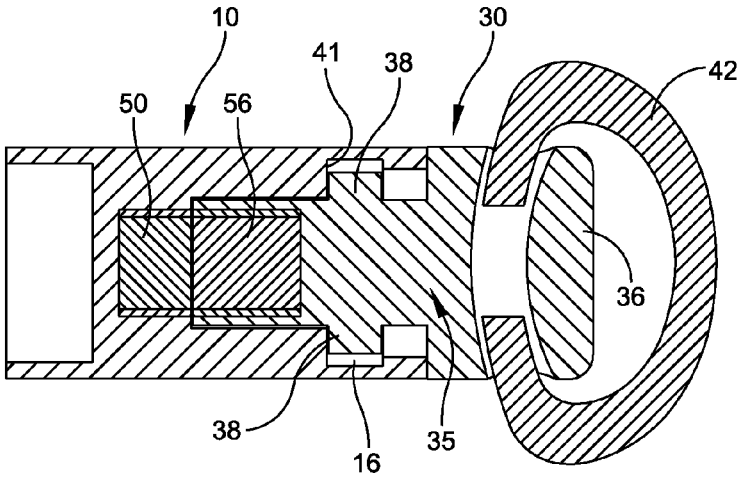
FIG. 7 is a cross-sectional view taken along line 7-7 of FIG. 6.

Each of the base pieces is also provided with an opening 33. This opening 33 is for receipt of the band 13 or any other type of elongated support structure. Each of the magnetic members 50 and 56 is preferably supported by means of an associated sleeve illustrated in the cross-sectional views. The abutting surfaces 51 and 59 of the magnetic members 50 and 56 are constructed to be planar and to provide full contact between these surfaces as illustrated in FIGS. 7 and 10. As indicated previously, as the insert piece is inserted toward a position such as illustrated in FIG. 5, there is an attraction force as illustrated by arrow B in FIG. 5 between these magnetic members. This assists in the insertion process while at the same time, as illustrated in FIG. 7, the posts 38 bottom out against a wall 41 of the annular slot 16.

As indicated previously, FIG. 11 illustrates one use of the clasp of the present invention. In the embodiment of FIG. 11, both of the clasps 17 may be of the same construction as illustrated in FIGS. 1-10, or only one of the clasps 17 may be of that construction.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A combination jewelry band, pair of clasps, and a charm adapted to be supported between the respective clasps, said combination comprising: a first clasp and a second clasp, each clasp including a base piece having an open passage at one side thereof; and an insert piece having an attachment end and an insert end; a first magnetic member disposed at a bottom of the open passage; and a second magnetic member disposed at a free end of the insert end of the insert piece; each clasp secured at opposed ends of the jewelry band; each said clasp including a securing loop for attachment with a charm; each said base piece having an entry slot and an annular slot disposed inward of said entry slot; said entry slot having a keyhole shape including a circular middle portion and parallel straight walled end portions; each said base piece being cylindrical and having a uniform outer diameter extending between opposite sides thereof and a free end stub that supports each first magnetic member; each said insert piece including a cylindrical head having an outer diameter that is substantially the same as the uniform outer diameter of the base piece, and a cylindrical stem having an outer diameter that is less than the outer diameter of the head, and that is integrally formed with the head; a pair of posts that extend from diametrically opposed sides of the cylindrical stem and that are each spaced from the head; said insert piece for insertion through the entry slot and for engagement of the posts with the annular slot; said insert piece cylindrical stem and diametrically opposed posts engaging through the entry slot with the cylindrical stem accommodated within the circular middle portion of the entry slot while respective posts are accommodated within the respective parallel straight walled end portions of the entry slot; each said securing loop mounted from a respective head of the insert piece and including an open loop having ends thereof accommodated in a channel in each head; said charm also having respective opposite end attachment loops for supporting the charm between the insert pieces; the securing loops mounted at the respective heads being engaged with the respective opposite end attachment loops of the charm; wherein the posts pass through the entry slot when in the insert position and the insert piece is rotated in the annular slot in the locked position in order to secure the insert piece with the base piece.

2. The combination of claim 1 wherein each head securing loop is pivotal relative to the channel.

3. The combination of claim 1 wherein each post is cylindrical and each extends outward from an outer surface of the cylindrical stem.

4. The combination of claim 1 wherein the channel is a through channel and each head securing loop has free ends disposed within ends of the channel.

5. The combination of claim 1 wherein, when the insert piece is being inserted the magnetic members are in facing arrangement and provide a force therebetween in a longitudinal direction of the clasp.

6. The combination of claim 1 wherein the outer diameter of the head is substantially the same as the outer diameter of the base piece.

7. The combination of claim 1 wherein each head securing loop is pivotal relative to the channel; each post is cylindrical; the channel is a through channel and each head securing loop has free ends disposed within ends of the channel; when the insert piece is being inserted the magnetic members are in facing arrangement and provide a force therebetween in a longitudinal direction of the clasp; and the outer diameter of the head is substantially the same as the outer diameter of the base piece.

* * * * *